US010913295B2

(12) United States Patent
Yu et al.

(10) Patent No.: US 10,913,295 B2
(45) Date of Patent: Feb. 9, 2021

(54) ANTI-STUCK DRIVING DEVICES AND PRINTERS USING THE SAME WITH MALFUNCTION REPAIRING

(71) Applicant: XIAMEN PRT TECHNOLOGY CO., LTD., Xiamen (CN)

(72) Inventors: Lianding Yu, Xiamen (CN); Chunpeng Wu, Xiamen (CN)

(73) Assignee: XIAMEN HANIN ELECTRONIC TECHNOLOGY CO., LTD., Xiamen (CN)

( * ) Notice: Subject to any disclaimer, the term of this patent is extended or adjusted under 35 U.S.C. 154(b) by 171 days.

(21) Appl. No.: 16/070,524

(22) PCT Filed: Sep. 1, 2017

(86) PCT No.: PCT/CN2017/100110
§ 371 (c)(1),
(2) Date: Jul. 17, 2018

(87) PCT Pub. No.: WO2018/188254
PCT Pub. Date: Oct. 18, 2018

(65) Prior Publication Data

US 2019/0389232 A1 Dec. 26, 2019

(30) Foreign Application Priority Data

Apr. 13, 2017 (CN) ..... 2017 1 0241041
Apr. 13, 2017 (CN) ..... 2017 1 0241135
Apr. 13, 2017 (CN) ..... 2017 1 0241531

(51) Int. Cl.
*B41J 11/70* (2006.01)
*B41J 3/24* (2006.01)

(52) U.S. Cl.
CPC ..... *B41J 11/70* (2013.01); *B41J 3/24* (2013.01)

(58) Field of Classification Search
CPC ..... B41J 11/70
(Continued)

(56) References Cited

U.S. PATENT DOCUMENTS 5,505,552 A 4/1996 Hasegawa et al.
6,152,007 A * 11/2000 Sato ..... B26D 1/0006 83/202

(Continued)

FOREIGN PATENT DOCUMENTS

CN 206644485 U 11/2017

OTHER PUBLICATIONS

International Search Report of PCT/CN2017/100110.

*Primary Examiner* — Anthony H Nguyen

(57) ABSTRACT

An anti-stuck driving device comprises: a movable blade, a movable blade driving unit, and a controller. The movable blade driving unit comprises a transmission assembly, a motor configured to drive the transmission assembly, and a connecting element connected between the transmission assembly and the motor. The transmission assembly links the movable blade moving back and forth linearly. The controller connects to the motor. When the movable blade is stuck, the controller controls the motor to drive the connecting element to rotate in reverse to separate the transmission assembly and the connecting element, and release a resistance of the transmission assembly. The present invention also discloses a printer using the anti-stuck driving device with malfunction repairing.

3 Claims, 9 Drawing Sheets

(58) Field of Classification Search
USPC ..... 101/93.07
See application file for complete search history.

(56) References Cited

U.S. PATENT DOCUMENTS

| | | | | |
|---|---|---|---|---|
| 6,164,854 | A * | 12/2000 | Otsuki | B26D 1/305 400/621 |
| 7,604,426 | B2 * | 10/2009 | Hanaoka | B26D 5/14 400/611 |
| 8,794,116 | B2 * | 8/2014 | Tamura | B26D 7/2614 83/74 |
| 2004/0184863 | A1 * | 9/2004 | Mori | B26D 5/08 400/621 |
| 2010/0143018 | A1 * | 6/2010 | Kawaguchi | B41J 11/70 400/621 |
| 2011/0259163 | A1 * | 10/2011 | Supron | B41J 11/70 83/13 |
| 2012/0219344 | A1 * | 8/2012 | Kishi | B26D 5/086 400/621 |
| 2015/0251457 | A1 * | 9/2015 | Lee | B26D 5/14 83/563 |
| 2018/0093504 | A1 * | 4/2018 | Kasai | B26D 1/085 |

* cited by examiner

ANTI-STUCK DRIVING DEVICES AND PRINTERS USING THE SAME WITH MALFUNCTION REPAIRING

CROSS REFERENCES TO RELATED APPLICATION

The present application is a 35 U.S.C. § 371 National Phase conversion of International (PCT) Patent Application No. PCT Application No. PCT/CN2017/100110 filed on Sep. 1, 2017, which claims foreign priority of Chinese Patent Application Nos. 201710241041.3, filed on Apr. 13, 2017, 201710241135.0, filed on Apr. 13, 2017, and 201710241531.3, filed on Apr. 13, 2017, in the State Intellectual Property Office of China, the disclosures of all of which are hereby incorporated by reference.

TECHNICAL FIELD

The present invention generally relates to a printer, and more particularly to an anti-stuck driving device and a printer using the same with malfunction repairing.

BACKGROUND

Currently, a typical printer comprises a cutting mechanism used for cutting recording paper. The cutting mechanism typically comprises a fixed blade and a movable blade. When cutting the recording paper, the movable blade is located on an upper surface of the fixed blade and cut by the fixed blade and the movable blade. However, during the cutting process, the recording paper could be stuck between the fixed blade and the movable blade. At this time, the printing process should be interrupted to recover the operation. During the recovery process, the lid of the printer must be opened to manually move the movable blade by force. This may damage the edge of the fixed blade and the movable blade.

SUMMARY

An object of the present disclosure is to provide an anti-stuck driving device, which can resolve paper stuck between the fixed blade and the movable blade.

An anti-stuck driving device can include a movable blade configured for cutting recording paper, a movable blade driving unit comprising a transmission assembly, a motor configured to drive the transmission assembly, and a connecting element connected between the transmission assembly and the motor, wherein the transmission assembly links the movable blade moving back and forth linearly, and a controller connected to the motor. When the movable blade is stuck, the controller controls the motor to drive the connecting element to rotate in reverse to separate the transmission assembly and the connecting element, and release a resistance of the transmission assembly.

Furthermore, the transmission assembly can comprise a first transmission element cooperating with the connecting element. The first transmission element comprises a connecting part located in a direction of an output shaft of the motor. The connecting element comprises a cooperating part cooperating with the connecting part. The connecting part comprises a first driving surface. The cooperating part comprises a first cooperating surface cooperating with the first driving surface. When the motor is operating in the forward direction, the first driving surface cooperates with the first cooperating surface. When the motor operates in the reverse direction, the first driving surface separates from the first cooperating surface.

Furthermore, the transmission assembly can comprise a second transmission element cooperating with the first transmission element. The transmission assembly further comprises a cam eccentrically located on the second transmission element. The cam connects with the movable blade.

Furthermore, the connecting part can comprise a reverse driving surface. The cooperating part comprises a second cooperating surface cooperating with the reverse driving surface. The connecting element drives the first transmission element rotate reversely by the cooperation between the reverse driving surface and the second cooperating surface.

The anti-stuck driving device of the present disclosure has the following advantages. Because the connecting element is connected between the transmission assembly and the motor, when the movable blade is stuck, the controller controls the motor to drive the connecting element rotate in reverse to separate the connecting element from the transmission assembly. Thus, a resistance of the transmission assembly can be released to prevent the edge of the movable blade from being damaged.

An object of the present disclosure is to provide a printer with malfunction repairing, which can resolve paper stuck between the fixed blade and the movable blade.

A printer with malfunction repairing can comprise a base with an anti-stuck driving device located on the base, and a repairing device linking the anti-stuck driving device moving back and forth linearly, and comprising an irregular element, an elastic element capable of extending along a moving direction of the anti-stuck driving device, and a driving assembly capable of rotating the irregular element. The elastic element connects between the anti-stuck driving device and the base.

Furthermore, the irregular element can comprise a protruding part. When the irregular element rotates, the protruding part drives the anti-stuck driving device to move along a first direction. When the protruding part separates from the movable blade, the elastic element makes the anti-stuck driving device move along a second direction opposite to the first direction by the elastic force.

Furthermore, the irregular element can be a cam shaft. The cam shaft comprises a demising part located on a side. The cam shaft pushes against a side of the anti-stuck driving device.

Furthermore, the driving assembly can comprise a rotatable hand shank located on the base. The rotatable hand shank is fixed on the irregular element and rotates with the irregular element.

Furthermore, the driving assembly can comprise a pusher and a gear engaged with the pusher. The gear is fixed on the demising part.

A printer with malfunction repairing can comprise a base, the anti-stuck driving device located on the base, a repairing device linking the anti-stuck driving device moving back and forth linearly, and a controlling system comprising the controller, a detecting switch and a limit switch. The limit switch sends a first signal to the controlling system when it is triggered by the repairing device. The detecting switch sends a second signal to the controlling system when it is triggered by the anti-stuck driving device. A malfunction can be detected and repaired by the controlling system according to the first signal and the second signal.

The printer of the present disclosure has the following advantages. When the movable blade is stuck, the repairing device can link the movable blade of the anti-stuck driving device moving back and forth linearly to release the movable blade. Thus, the stuck movable blade can be released and the stuck recording paper can be taken out without damaging the movable blade or opening the lid.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "a" embodiment in this disclosure are not necessarily to the same embodiment, and such references mean "at least one."

First Embodiment

Figure 1:
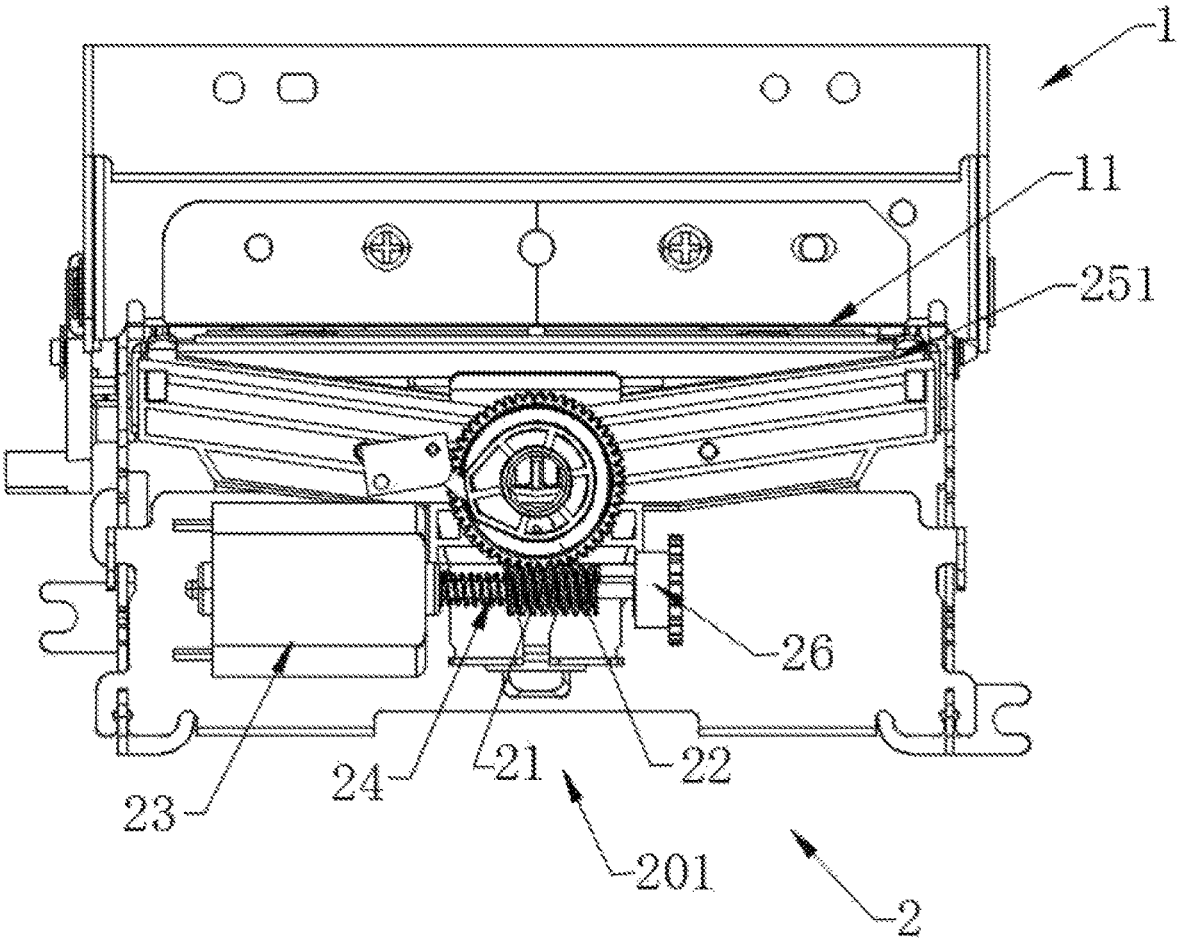
FIG. 1 is a structure schematic of a first view of an anti-stuck driving device according to an embodiment of the present disclosure.
Figure 2:
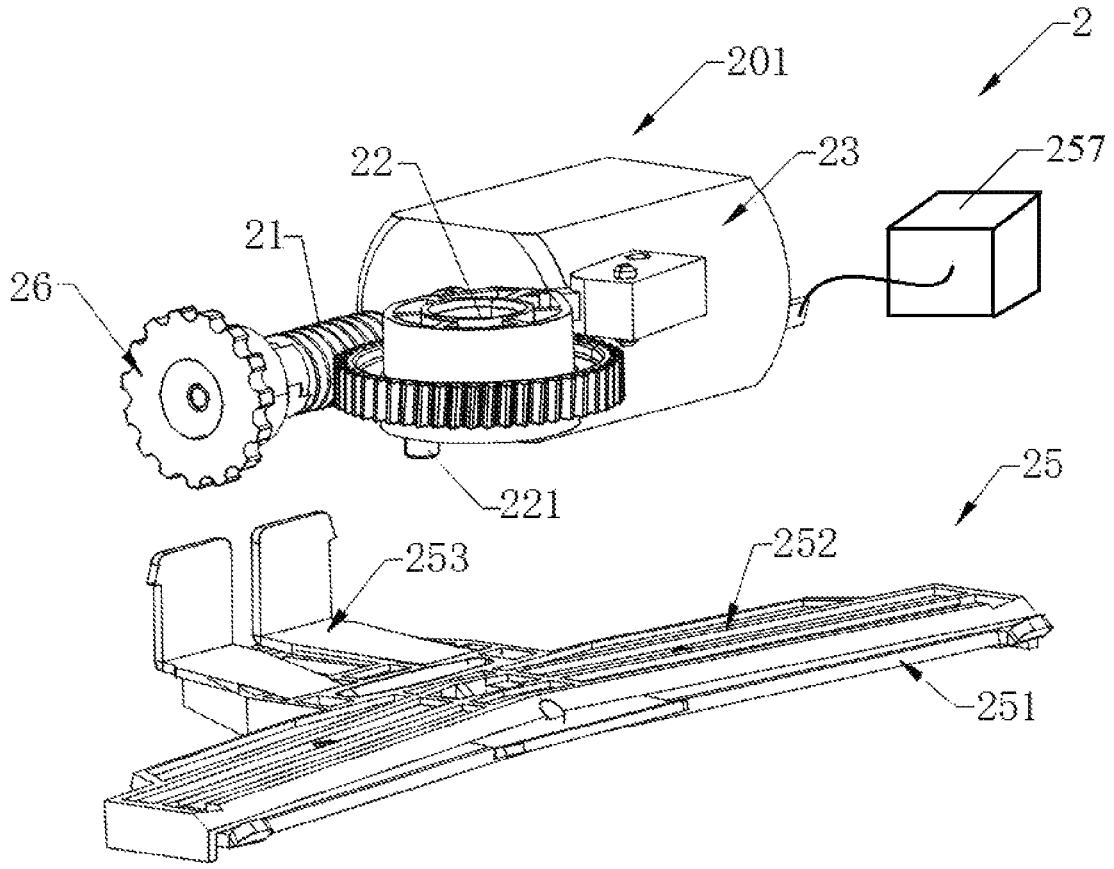
FIG. 2 is a exploded schematic of partial structure of the anti-stuck driving device according to an embodiment of the present disclosure.
Figure 3:
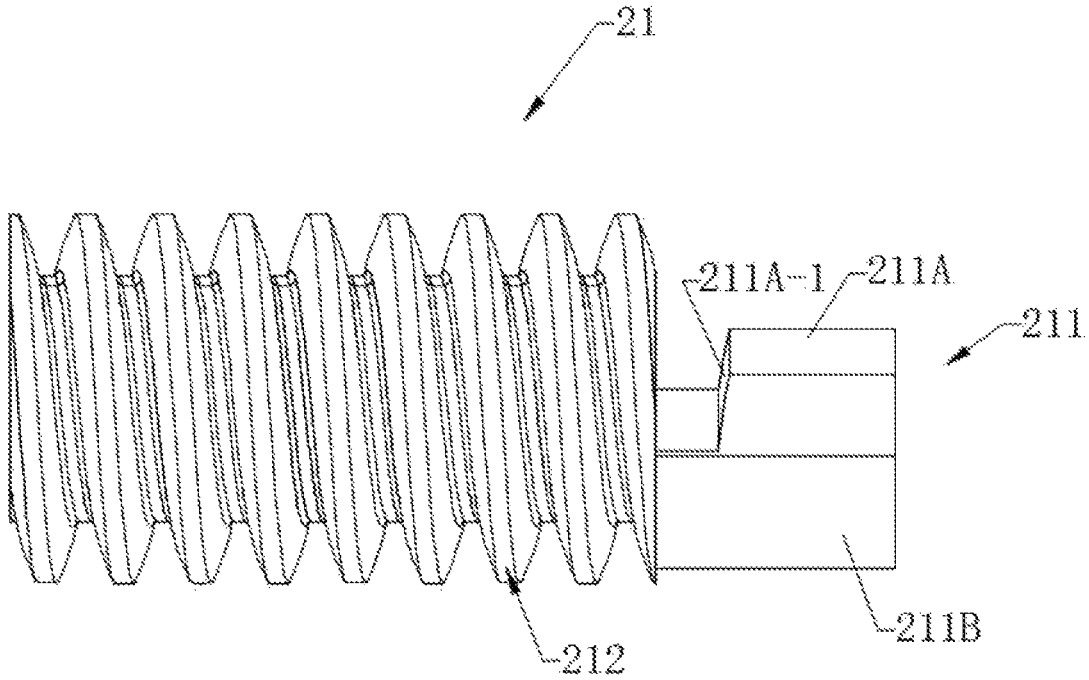
FIG. 3 is a structure schematic of a first transmission element of the anti-stuck driving device according to an embodiment of the present disclosure.
Figure 4:
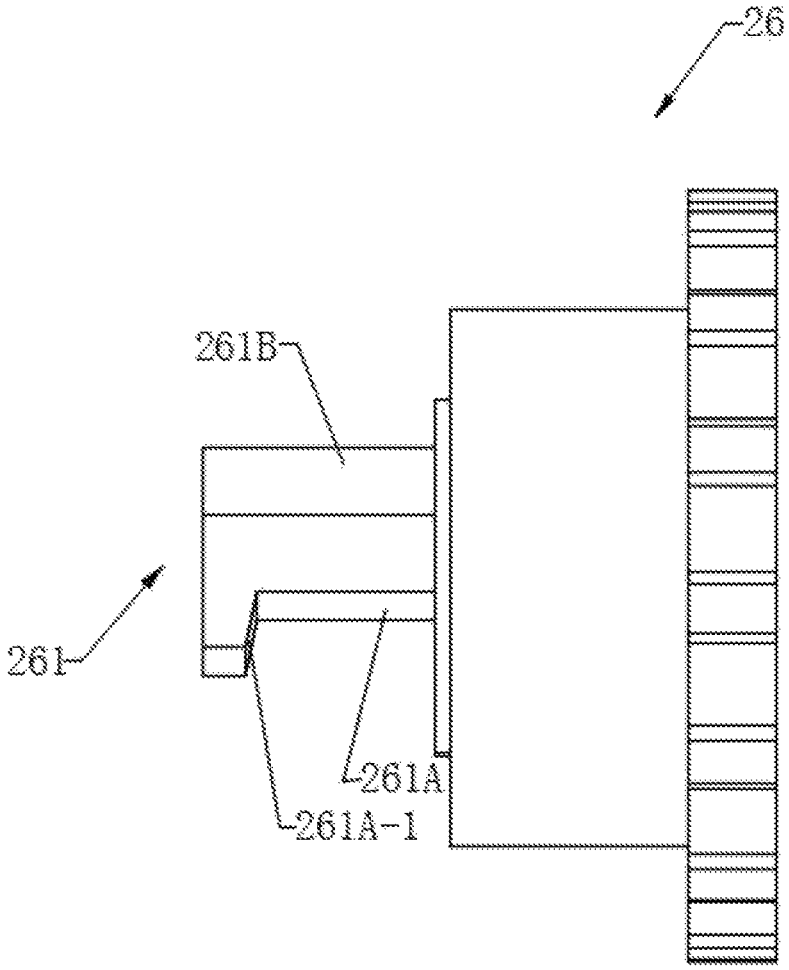
FIG. 4 is a structure schematic of a connecting element of the anti-stuck driving device according to an embodiment of the present disclosure.

Referring to FIGS. 1 and 4, an anti-stuck driving device 2 of one embodiment of the present disclosure comprises: a movable blade assembly 25 comprising a movable blade 251, a movable blade driving unit 201 and a controller 257. The movable blade driving unit 201 drives the movable blade 251 to move back and forth linearly. The movable blade 251 is configured for cutting recording paper together with a fixed blade 11 of the printer.

The movable blade 251 can move back and forth with respect to the fixed blade 11. A side of the movable blade 251 adjacent to the fixed blade 11 comprises a V-shaped cutting edge. When the movable blade 251 moves towards the fixed blade 11, the recording paper located therebetween can be cut. In one embodiment, the movable blade assembly 25 further comprises a movable blade holder 252 and a pretension element 253. The movable blade 251 is located on the movable blade holder 252. The pretension element 253 presses on the movable blade 251 to form a contact force between the movable blade 251 and the fixed blade 11. Thus, the recording paper can be cut by the movable blade 251 and the fixed blade 11.

The movable blade driving unit 201 comprises a transmission assembly (not labeled), a motor 23 configured to drive the transmission assembly, and a connecting element 26 connected between the transmission assembly and the motor 23. The transmission assembly links the movable blade 251 moving back and forth linearly.

The controller 257 connects to the motor 23. During a normal cutting process, the motor 23 is controlled by the controller 257 to drive the connecting element 26 to rotate or move in a forward direction. When the movable blade 251 is stuck, the controller 257 controls the motor 23 to rotate or move in reverse together with the connecting element 26. Thus, the connecting element 26 can be separated from the transmission assembly, so that a resistance of the transmission assembly can be released.

A connection between the motor 23 and the transmission assembly is built by the connecting element 26. Thus, when the movable blade 251 is stuck, the motor 23 rotates or moves in reverse to separate the connecting element 26 from the transmission assembly. Therefore, the connection between the motor 23 and the transmission assembly can be disconnected.

The transmission assembly comprises a first transmission element 21 cooperating with the connecting element 26, and a second transmission element 22 cooperating with the first transmission element 21. In one embodiment, the transmission assembly further comprises a cam 221 eccentrically located on the second transmission element 22. The cam 221 connects with the movable blade 251. In some embodiments, other kinds of transmission elements, such as gear transmission structure, worm gear transmission structure or belt transmission structure, can be further added between the first transmission element 21 and the transmission element 22.

The first transmission element 21 comprises a connecting part 211 located on direction of an output shaft of the motor 23. The connecting part 211 comprises a first driving surface 211A and a reverse driving surface 211B. The connecting element 26 comprises a cooperating part 261 cooperating with the connecting part 211. The cooperating part 261 comprises a first cooperating surface 261A cooperating with the first driving surface 211A and a second cooperating surface 261B cooperating with the reverse driving surface 211B.

During a normal cutting process, the first driving surface 211A cooperates with the first cooperating surface 261A. Thus, the motor 23 can drive the first transmission element 21 to rotate positively by the connecting element 26. When the movable blade 251 is stuck, the motor 23 can drive the connecting element 26 to rotate in reverse to separate the first driving surface 211A from the first cooperating surface 261A. After rotating in reverse by a certain amount, the second cooperating surface 261B can cooperate with the reverse driving surface 211B. Thus, the connecting element 26 can drive the first transmission element 21 to rotate in reverse.

The connecting element 26 and the first transmission element 21 can quickly switch between a forward driving state and a reverse driving state by a forward cooperation of the first driving surface 211A and the first cooperating surface 261A and a reverse cooperation of the second cooperating surface 261B and the reverse driving surface 211B. Therefore, the normally working driving operation can be achieved and the movable blade 251, when stuck, can also be quickly released.

In one embodiment, the first transmission element 21 is a worm rod, and the second transmission element 22 is a worm wheel. The transmission element 21 comprises a screw part 212. The connecting part 211 is located on an end of the screw part 212. The first transmission element 21 is sheathed on an output shaft of the motor 23. The first transmission element 21 is in clearance fit with the output shaft of the motor 23. The connecting element 26 is also sheathed and fixed on an output shaft of the motor 23.

The worm rod and the worm wheel can improve the transmission stability. Because the first transmission element 21 is in clearance fit with the output shaft of the motor 23, the first transmission element 21 can be driven by the second transmission element 22 to rotate in reverse. Thus, the problem that the worm wheel cannot drive the worm rod to rotate can be solved. The first transmission element 21 and the second transmission element 22 can achieve automatically, reverse transmission without other assistance by the resistance. Thus, the resistance can be released quickly and effectively to prevent damage of the fixed blade and the movable blade by compulsively releasing the resistance.

The motor 23 comprises a main body (not labeled). The first transmission element 21 is located between the main body and the connecting element 26. A reset element 24 is further located between the main body and the first transmission element 21. In one embodiment, the reset element 24 is a coil spring sheathed on the output shaft of the motor 23. During the process of releasing resistance, the second transmission element 22 drives the first transmission element 21 to rotate in reverse and then separate from the connecting element 26. At this moment, the reset element 24 is pressed by the first transmission element 21. After the process of releasing resistance, the reset element 24 generates an elastic force on the first transmission member 21 so that the first transmission member 21 can closely reestablish a connection with the connecting element 26.

In one embodiment, the connecting part 211 protrudes along the axial direction of its output shaft. The first driving surface 211A and the reverse driving surface 211B are located on opposite sides of the connecting part 211. The first driving surface 211A comprises a groove (not labeled). The groove comprises an inclined surface 211A-1. The cooperating part 261 extends from the connecting element 26 and face to the connecting part 211. The first cooperating surface 261A and the second cooperating surface 261B are located on opposite sides of the cooperating part 261. A hook (not labeled) protrudes from the first cooperating surface 261A and matches with the groove. The hook comprises an inclined cooperating surface 261A-1 matching with the inclined surface 211A-1. Thus, the connecting element 26 can smoothly connect and dis-connect with the first transmission element 21.

Embodiments 2

Figure 5:
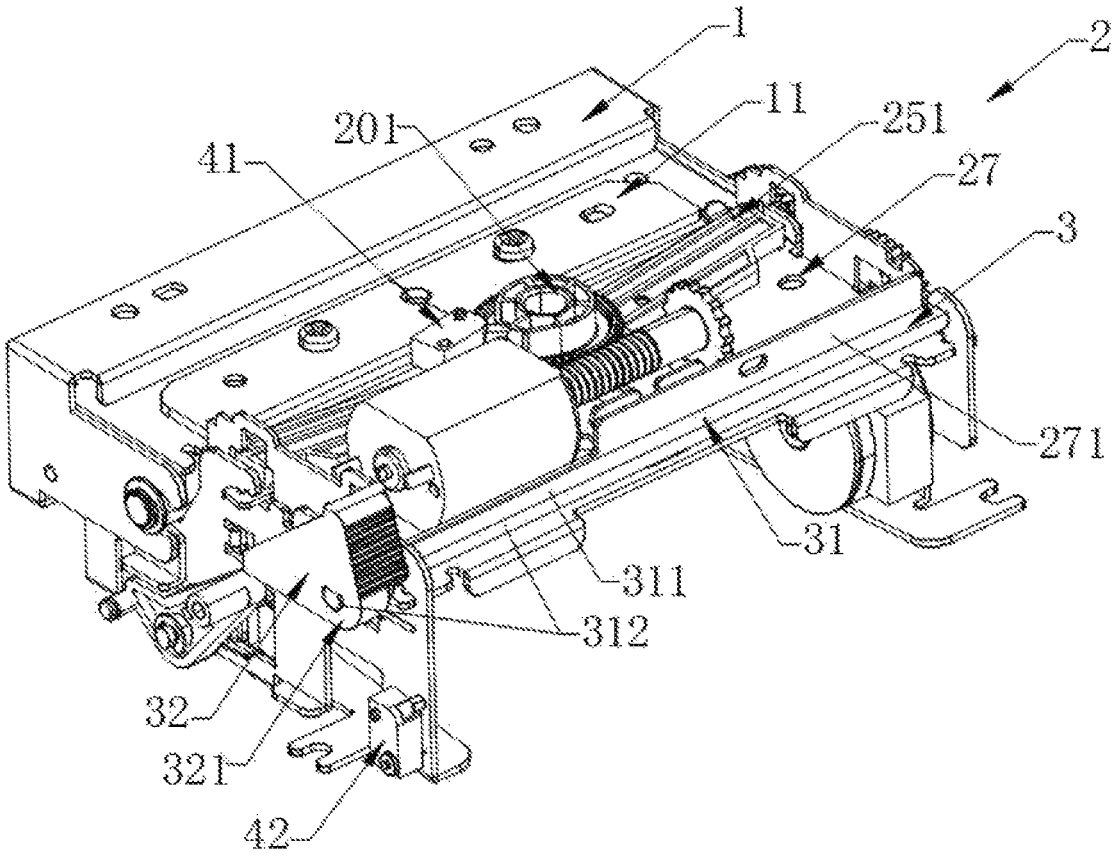
FIG. 5 is a structure schematic of a first view of an printer with malfunction repairing according to another embodiment of the present disclosure.
Figure 6:
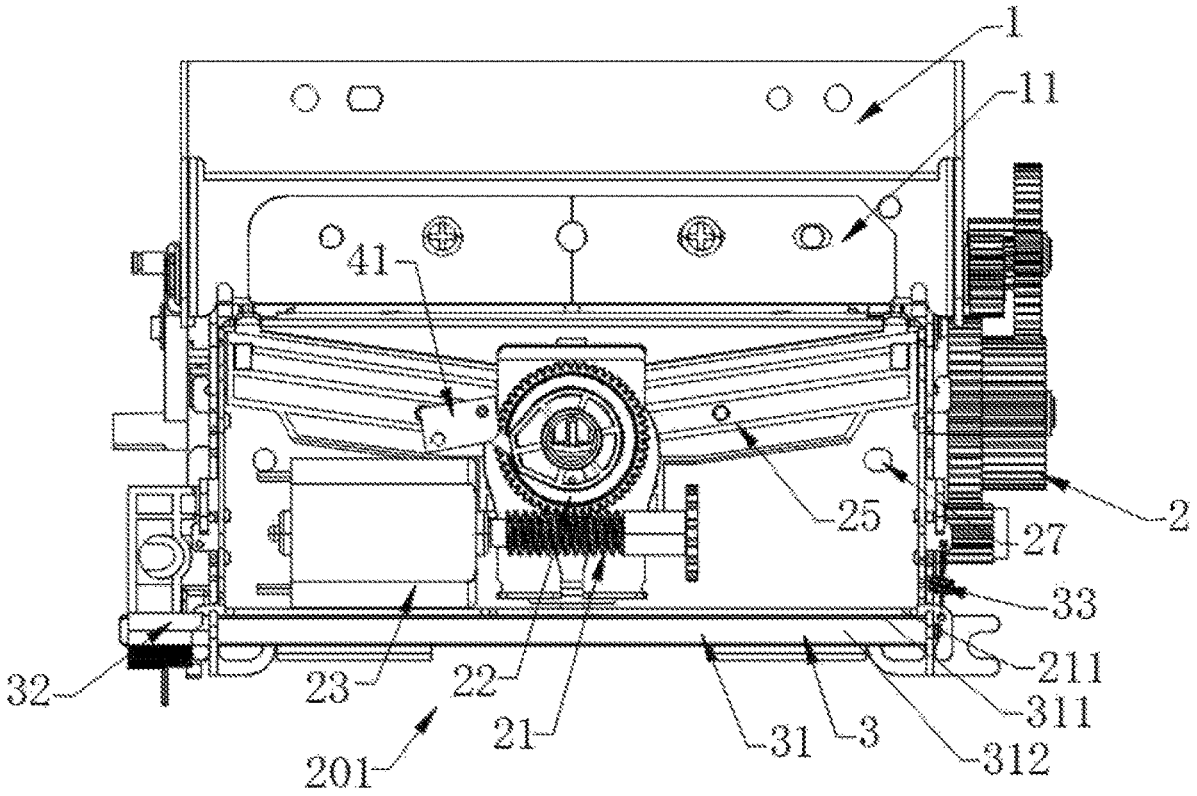
FIG. 6 is a structure schematic of a second view of an printer with malfunction repairing according to an embodiment of the present disclosure.
Figure 7:
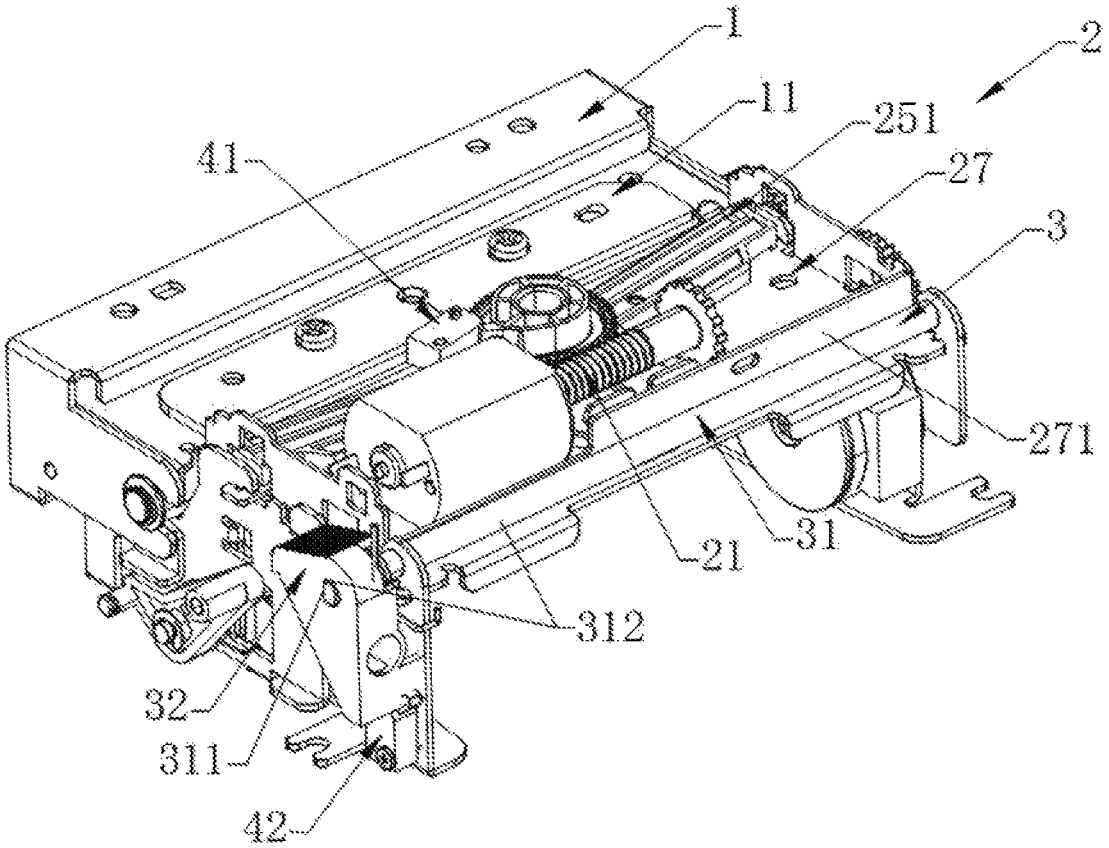
FIG. 7 is an operating statement view of the printer when a limit switch is triggered by a repairing device according to an embodiment of the present disclosure.

Referring to FIGS. 5-7, a printer with malfunction repairing of one embodiment of the present disclosure comprises: a base 1; the anti-stuck driving device 2 located on the base 1; and a repairing device 3 linking the anti-stuck driving device 2 moving back and forth linearly. When the movable blade 251 is stuck, the repairing device 3 links the anti-stuck driving device 2 moving back and forth linearly to release the stuck movable blade 251.

The anti-stuck driving device 2 comprises the movable blade 251, the movable blade driving unit 201 and the controller 257. The controller 257 connects with the motor 23. The movable blade driving unit 201 drives the movable blade 251 moving back and forth linearly. The movable blade 251 is configured for cutting recording paper together with the fixed blade 11 of the printer. The movable blade driving unit 201 comprises a transmission assembly (not labeled), the motor 23 configured to drive the transmission assembly, and a connecting element 26 connected between the transmission assembly and the motor 23. The transmission assembly links the movable blade 251 moving back and forth linearly.

The transmission assembly comprises the first transmission element 21 and the second transmission element 22 cooperating with the first transmission element 21. In one embodiment, the first transmission element 21 is a worm rod and is located on the output shaft of the motor 23. The second transmission element 22 is a worm wheel gearing with the worm rod. The transmission assembly further comprises a connecting rod (not labeled) eccentrically located on the second transmission element 22. The connecting rod connects with the movable blade 251.

The repairing device 3 comprises an irregular element 31, an elastic element 33 capable of extending along a moving direction of the anti-stuck driving device 2, and a driving assembly 32 capable of rotating the irregular element 31. The elastic element 33 connects between the anti-stuck driving device 2 and the base 1. The repairing device 3 links the anti-stuck driving device 2 moving back and forth linearly by the irregular element 31 and the elastic element 33. The stuck movable blade 251 can be quickly released by the repairing device 3, and the stuck recording paper can be removed without damaging the movable blade 251 and opening the lid of the printer.

In one embodiment, the irregular element 31 comprises a protruding part 312. When the irregular element 31 rotates, the protruding part 312 drives the anti-stuck driving device 2 to move along a first direction. When the protruding part 312 separates from the anti-stuck driving device 2, the elastic element 33 makes the anti-stuck driving device 2 move along a second direction opposite to the first direction by the elastic force of the elastic element 33. In one embodiment, the elastic element 33 comprises a coil spring.

In one embodiment, the irregular element 31 is a cam shaft. The cam shaft comprises a demising part 311 located on a side. The anti-stuck driving device 2 comprises a main holder (not labeled). The irregular element 31 locates on outside of the main holder. The cam shaft pushes against a side of the anti-stuck driving device 2. Two ends of the irregular element 31 are rotationally located on the base 1. One end of the irregular element 31 protrudes from the base 1 and connects with the driving assembly 32. The main holder comprises a curved edge 271. The curved edge 271 is perpendicular to a moving direction of the power unit 2. The irregular element 31 pushes against the curved edge 271.

The rotation control of the cam shaft is simple and convenient. A uniform press can be applied on the anti-stuck driving device 2 during the pushing process, because a linear contact is formed between the cam shaft and the curved edge 271. Thus, deflection movement of the anti-stuck driving device 2 can be avoided, and the anti-stuck driving device 2 can be stably fixed on the working position. In some embodiments, a structure of the irregular element 31 can be chosen according to different needs.

In one embodiment, the driving assembly 32 comprises a rotatable hand shank 321 located on the base 1. An end of the irregular element 31 extends into the rotatable hand shank 321 and is fixed on the rotatable hand shank 321. The rotatable hand shank 321 can rotate with the rotatable hand shank 321. The rotatable hand shank 321 comprises a cavity. A torsion spring is located between the rotatable hand shank 321 and the irregular element 31. The torsion spring sheaths on the irregular element 31 and locates in the cavity. The irregular element 31 can be rotated by the driving of the rotatable hand shank 321. Thus, the printer has a compact structure, and the operation of the printer is convenient.

When the anti-stuck driving device 2 is in the normal working state, the protruding part 312 pushes against the curved edge 271. Thus, the anti-stuck driving device 2 can be firmly secured to the desired position and the elastic element 33 can be stretched.

When the recording paper is stuck, the driving assembly 32 drives the irregular element 31 to rotate in order to separate the protruding part 312 from the curved edge 271. Thus, a gap is formed between the demising part 311 and the curved edge 271. At this moment, the anti-stuck driving device 2 is pulled to move towards the demising part 311 by elastic force of the elastic element 33. Thus, the anti-stuck driving device 2 can move away from the cutting position, and a resistance of the anti-stuck driving device 2 can be released. Therefore, the stuck recording paper can be easily removed without opening the lid of the printer.

Embodiment 3

Figure 8:
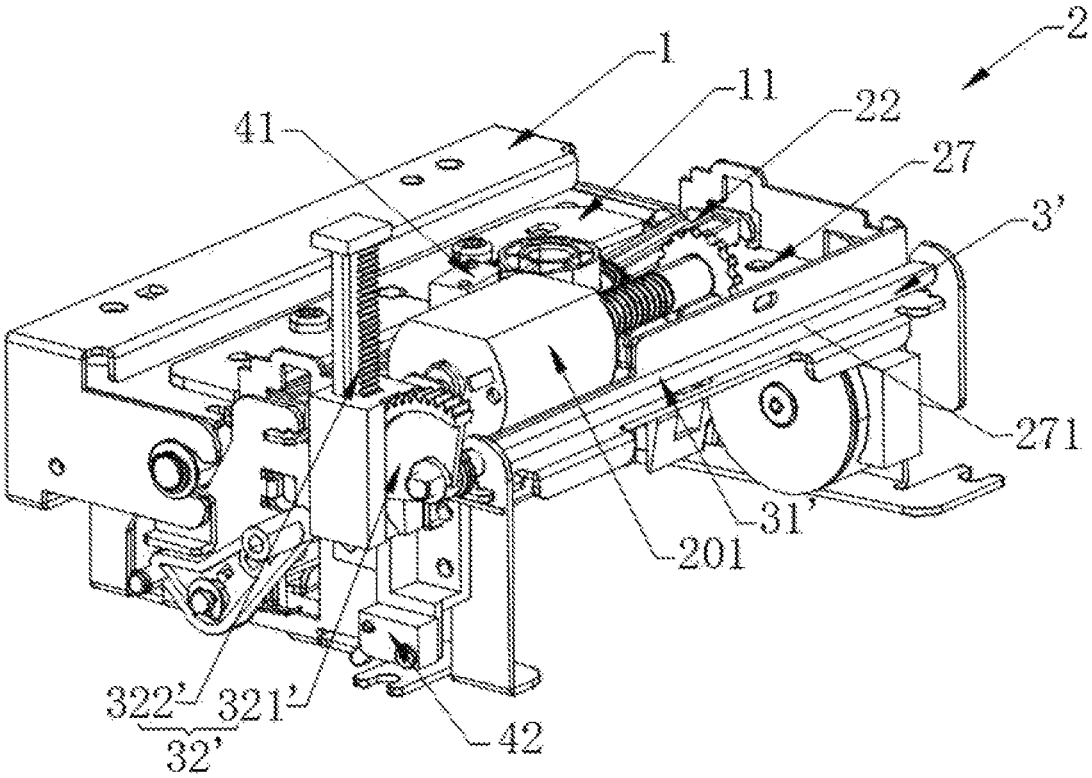
FIG. 8 is a structure schematic of a first view of an printer with malfunction repairing according to another embodiment of the present disclosure.
Figure 9:
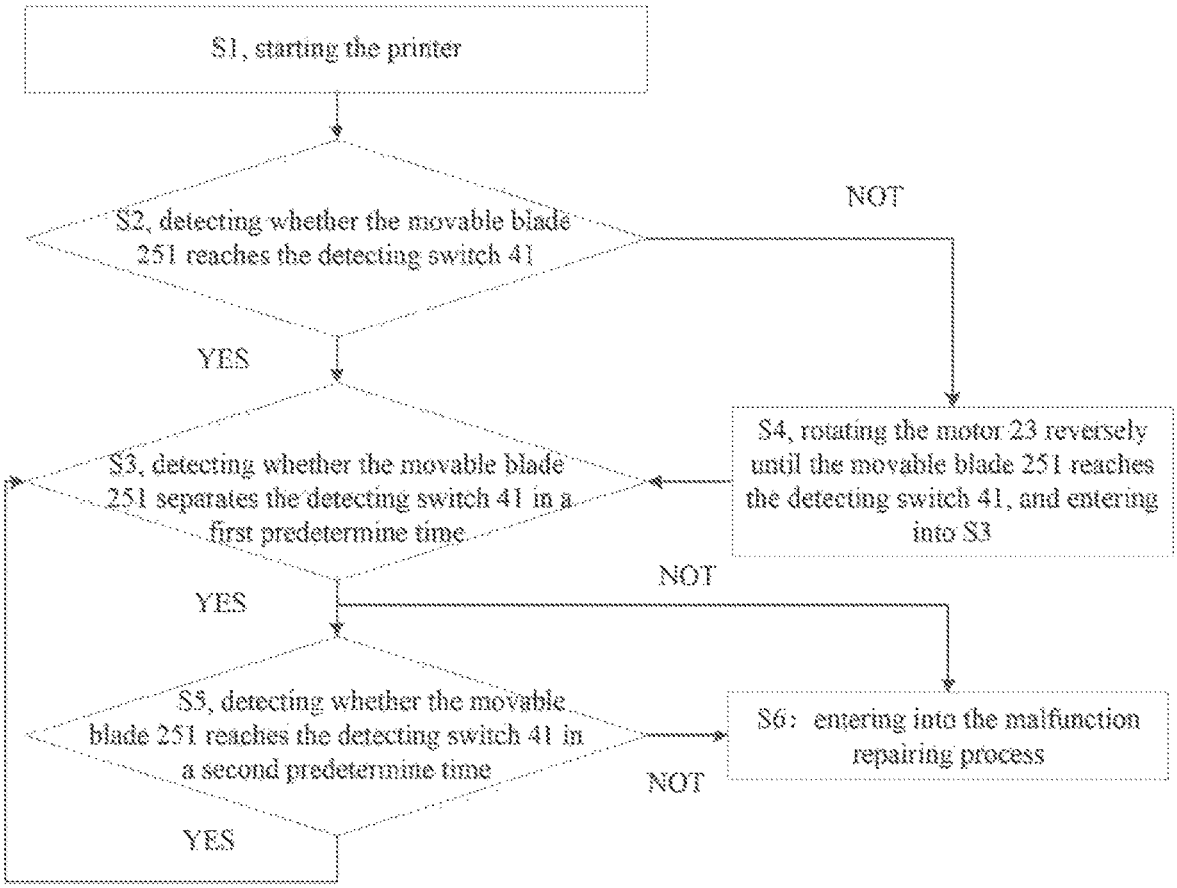
FIG. 9 is a flow chat of a controlling system of an printer with malfunction repairing according to an embodiment of the present disclosure.

Referring to FIG. 8, a printer with malfunction repairing of the embodiment 3 is basically the same as the printer with malfunction repairing of the embodiment 2. The difference is that the printer with malfunction repairing of the embodiment 3 comprises a driving assembly 32'. The driving assembly 32' comprises a pushing element 322' and a gear 321' gearing with the pushing element 322'. An end of the irregular element 31' extends into the gear 321' and is fixed on the gear 321'. The irregular element 31' can rotate with the gear 321'. The pushing element 322' comprises a gearing part gearing with the gear 321'. In one embodiment, the pushing element 322' is a rack structure. The gear 321' can be driven by the pushing element 322' to rotate in order to make the irregular element 31' rotate.

Embodiment 4

Referring to FIGS. 1 and 5-9, the printer with malfunction repairing of the embodiment 4 is basically the same as the printer with malfunction repairing of the embodiment 2. The difference is that the printer with malfunction repairing of the embodiment 4 further comprises a detecting switch 41 and a limit switch 42. The limit switch 42 sends a first signal to the controlling system when it is triggered by the repairing device 3. The detecting switch 41 sends a second signal to the controlling system when it is triggered by the anti-stuck driving device 2. A malfunction can be detected and be repaired by the controlling system according to the first signal and the second signal.

The present disclosure further discloses a method for repairing the malfunction of the printer. The method comprises steps of:

S1, starting the printer;

S2, detecting whether the movable blade 251 reaches the detecting switch 41, and if so, entering into S3, otherwise entering into S4;

S3, detecting whether the movable blade 251 separates the detecting switch 41 in a first predetermine time, and if so, entering into S5, otherwise entering into S6;

S4, rotating the motor 23 in reverse until the movable blade 251 reaches the detecting switch 41, and entering into S3;

S5, detecting whether the movable blade 251 reaches the detecting switch 41 in a second predetermine time, if yes, entering into S3, otherwise entering into S6; and S6: entering into the malfunction repairing process.

In one embodiment, the step S6 comprises sub-steps of:

S61: rotating the motor 23 in reverse until the movable blade 251 reaches the detecting switch 41; and S62: pulling the stuck recording paper from the movable blade 251 and the fixed blade.

In another embodiment, the step S6 comprises sub-steps of:

S63: driving the anti-stuck driving device 2 moving away from the cutting position by the repairing device 3 to release partial resistance;

S64: when the repairing device 3 reaches the limit switch 42, rotating the motor 23 reversely until the movable blade 251 reaches the detecting switch 41 to release partial resistance; and S65: pulling the stuck recording paper from the movable blade 251 and the fixed blade.

The above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. An anti-stuck driving device comprises:

a movable blade configured for cutting recording paper;

a movable blade driving unit comprising a transmission assembly, a motor configured to drive the transmission assembly, and a connecting element connected between the transmission assembly and the motor, wherein the transmission assembly links the movable blade moving back and forth linearly; and a controller connected to the motor;

wherein, when the movable blade is stuck, the controller controls the motor to drive the connecting element rotate reversely to separate the transmission assembly and the connecting element, and releases a resistance of the transmission assembly;

wherein the transmission assembly comprises a first transmission element cooperating with the connecting element, the first transmission element comprises a connecting part located on direction of output shaft of the motor, the connecting element comprises a cooperating part cooperating with the connecting part, the connecting part comprises a first driving surface, the cooperating part comprises a first cooperating surface cooperating with the first driving surface, when the motor rotates forwardly, the first driving surface cooperates with the first cooperating surface, when the motor rotates reversely, the first driving surface separates from the first cooperating surface.

2. The anti-stuck driving device as claimed in claim 1, wherein the transmission assembly comprises a second transmission element cooperating with the first transmission element, the transmission assembly comprises a cam eccentrically located on the second transmission element, the cam connects with the movable blade.

3. The anti-stuck driving device as claimed in claim 1, wherein the connecting part comprises a reverse driving surface, the cooperating part comprises a second cooperating surface cooperating with the reverse driving surface, and the connecting element drives the first transmission element to rotate in reverse by the cooperation between the reverse driving surface and the second cooperating surface.

* * * * *